US007086573B1

(12) United States Patent
Wen

(10) Patent No.: US 7,086,573 B1
(45) Date of Patent: Aug. 8, 2006

(54) BRAKE DEVICE FOR DE-ACTUATING A NAIL DRIVER WITHOUT NAILS THEREIN

(75) Inventor: Ming-Han Wen, Taipei (TW)

(73) Assignee: De Poan PNeumatic, Taipei Hsien (TW)

( * ) Notice: Subject to any disclaimer, the term of this patent is extended or adjusted under 35 U.S.C. 154(b) by 0 days.

(21) Appl. No.: 11/044,357

(22) Filed: Jan. 28, 2005

(51) Int. Cl.
*B25C 1/04* (2006.01)

(52) U.S. Cl. ..... 227/8; 227/120

(58) Field of Classification Search ..... 227/8, 227/120, 136, 130
See application file for complete search history.

(56) References Cited

U.S. PATENT DOCUMENTS 4,597,517 A * 7/1986 Wagdy ..... 227/8
5,683,024 A * 11/1997 Eminger et al. ..... 227/8
6,199,739 B1 * 3/2001 Mukoyama et al. ..... 227/8
6,264,085 B1 * 7/2001 Ho et al. ..... 227/8
6,308,880 B1 * 10/2001 Ronconi ..... 227/119
6,592,014 B1 * 7/2003 Smolinski ..... 227/8
6,609,646 B1 * 8/2003 Miller et al. ..... 227/8
6,913,179 B1 * 7/2005 Chen ..... 227/8
6,966,476 B1 * 11/2005 Jalbert et al. ..... 227/8
6,966,477 B1 * 11/2005 Chien-Kuo et al. ..... 227/8
6,994,240 B1 * 2/2006 Jakob et al. ..... 227/8
7,000,294 B1 * 2/2006 Kakuda et al. ..... 227/120

* cited by examiner

*Primary Examiner*—Scott A. Smith

(57) ABSTRACT

A braking unit for nail drivers, mainly a rotary retaining unit pivotally mounted on lateral sides of a punch channel of a nail driver, comprises a front blocking portion, a first cam, a second cam and a handle portion. The first cam is engaged with the securing slide rod so as to restrain the slide rod. The second cam is inserted into a punch channel to engaging nails within the channel. Thereby, when the nail cartridge is loaded, the retaining unit releases the securing slide rod so that the trigger can be pulled to punch a nail. It can sense the emptiness of the cartridge so as to restrain the slide rod and invalidate the trigger. The handle portion can be pushed so as to rotate the first cam and the second cam out of the punch channel, whereby a striking test with empty nail cartridge can be performed.

7 Claims, 7 Drawing Sheets

BRAKE DEVICE FOR DE-ACTUATING A NAIL DRIVER WITHOUT NAILS THEREIN

FIELD OF THE INVENTION

The present invention relates to braking units for nail drivers, more particularly to a braking unit utilizing a rotary retaining unit capable of sensing whether there is any nail in a nail driver and restraining or releasing the securing slide rod of the nail driver.

BACKGROUND OF THE INVENTION

The braking units for nail drivers of the prior art is to invalidate the trigger of a nail driver when the nail cartridge is empty, so that the user is reminded of reloading the puncher.

The above-mentioned multitude of nails are arranged in a row and inserted in a nail cartridge. They are then pushed to a punch channel one by one by a nail pusher. A user pulls a trigger and a nail in the punch channel is struck by a punch rod so that the nail will embedded in a workpiece. The trigger has a flexible plate and a trigger beam, which trigger beam is controlled by a securing slide rod with a transverse section. One end of the securing slide rod is connected to a fastener guide that situates outside a nail exit and is pressed against the surface of a workpiece when embedding a nail therein. The securing slide rod is used to tilt against the flexible plate so as to pull the trigger.

The punch-restraining technique of the prior art is basically a braking unit mounted on the nail pusher and a securing slide rod, whereby the nail pusher will restrain the securing slide rod when the nails are used up, so that the securing slide rod cannot touch the flexible plate within the trigger. Since the trigger is invalidated, the user will be reminded of reloading the puncher. However, this technique cannot detect whether there is any nail remained in the puncher. Further, it has the disadvantage that the motion of the nail pusher is difficult to control, resulting in the problem of nail jam.

Moreover, the invention disclosed in U.S. Pat. No. 6,267,284 utilizes a latch having a main cam and a second cam, wherein the second cam can restrain a fastener guide when there is any nail in a punch channel, invalidating a punch rod and the punching mechanism. The main cam will be pushed by the nails in the punch channel and rotate the latch to a position where the punch rod can work. However, the invention has the disadvantages as follows.

1. The swing latch does not have a flexible part and a manual control for the swing position of the latch. Without a flexible part, the latch will be short of a precise mechanism for restoring its initial location. When the punch channel is empty and the fastener guide is not engaged with a workpiece, the latch will wiggle, not being able to indicate the status of braking. When the punch channel is empty, it is also impossible to release the punch rod and perform a strike test.

2. The cross section of the main cam is triangular, which requires swing of higher precision in order not to intervene the punch rod in the punch channel. After using for an extended period of time, the main cam is easy to get struck by the punch rod.

3. The swing latch has a nose portion for restraining the fastener guide and an arced second cam. The nose and the second cam are used to restrain the fastener guide, instead of the securing slide rod, which is not consistent with the usual nail drivers having a securing slide rod with a bent transverse section connected to the fastener guide. Therefore, the invention cannot be easily used in common nail driver structures.

SUMMARY OF THE INVENTION

The primary objective of the present invention is to provide a braking unit for nail drivers that have a securing slide rod with a transverse section, whereby the striking mechanism can be restrained when the nail cartridge is empty. The braking unit can sense whether there is any nail in a nail driver and can restrain and release the securing slide rod.

A secondary objective of the present invention is to provide a braking unit for nail drivers, wherein the function of restraining the securing slide rod can be relaxed so that a striking test of the punch rod along the punch channel can be done.

To achieve above object, the present invention provides a braking unit for nail drivers that have a securing slide rod with a transverse section, said braking unit being a rotary retaining unit pivotally mounted on lateral sides of a punch channel of one said nail driver, comprising: a front blocking portion capable of engaging said transverse section of said securing slide rod; a first cam connected to said front blocking portion through a sloppy surface, said sloppy surface capable of engaging said transverse section of said securing slide rod so as to depart said retaining unit from said punch channel; a second cam connected to said first cam through a recess, said second cam capable of being inserted into said punch channel for touching a plurality of nails therein, said second cam being pushed by said nails and activating a rotation of said first cam and said front blocking portion; and a handle portion formed in a lateral end of said retaining unit, whereby said handle portion will be pushed so as to rotate said first cam and said second cam of said retaining unit out of said punch channel.

The various objects and advantages of the present invention will be more readily understood from the following detailed description when read in conjunction with the appended drawings:

DETAILED DESCRIPTION OF THE PREFERRED EMBODIMENTS

Figure 1:
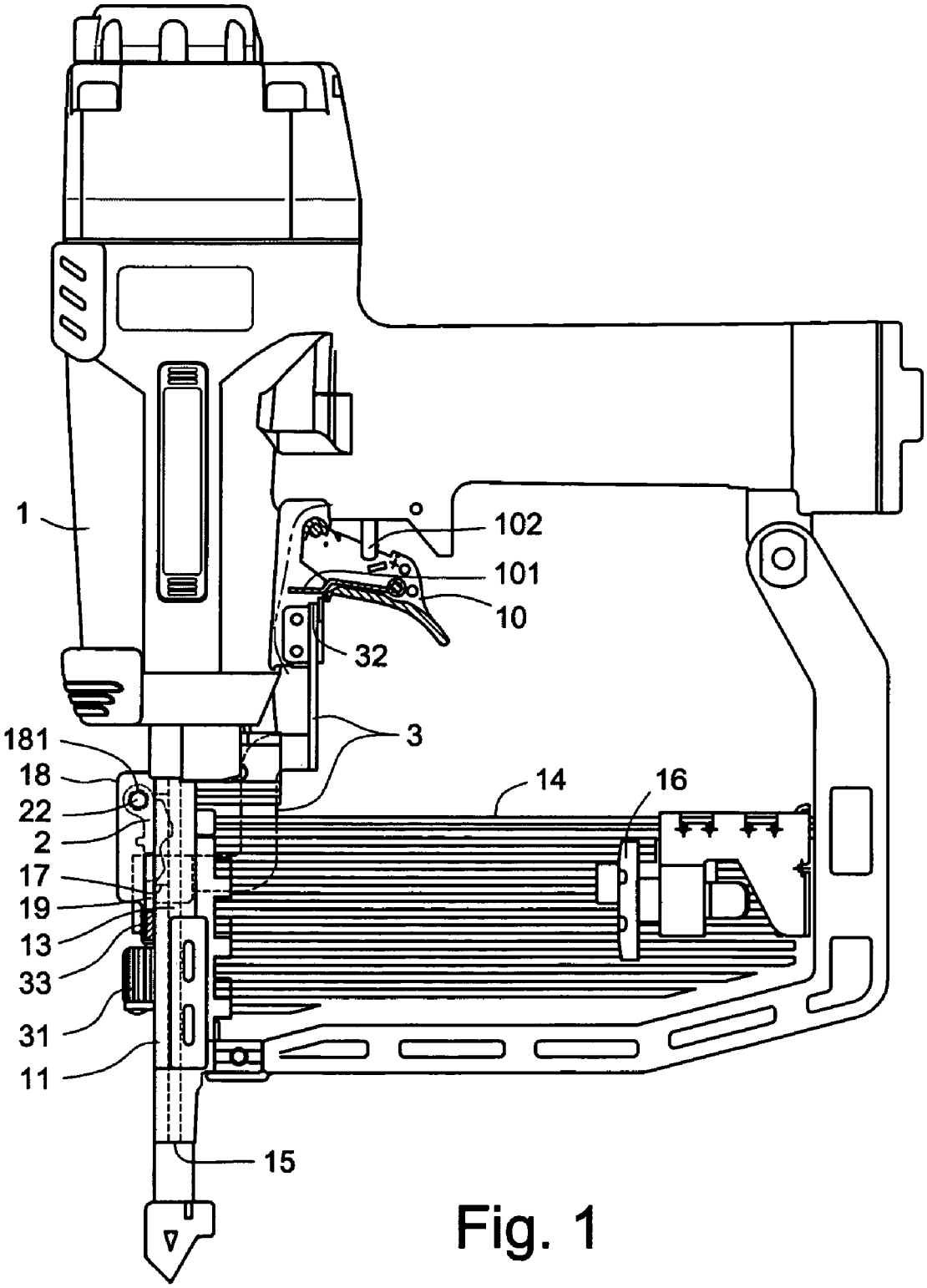
FIG. 1 is a lateral view of a nail driver referred by the present invention for illustrating the locations of the trigger, the securing slide rod, the retaining unit and the outer cover.

Referring to FIG. 1, a preferred embodiment of the present invention as a braking unit for nail drivers comprises retaining slot 17 formed on a cover plate 11 mounted on an outer side of a punch channel 13, an outer cover 18 installed on the cover plate 11 for shielding the retaining slot 17, and a retaining unit 2 pivotally connected to the outer cover 18 by an axle 22 passing through a pair of pivot holes 181 formed on two lateral sides of an outer cover 18. Thereby, the retaining unit 2 can rotate so as to insert one end portion thereof into the punch channel 13. At the same time, each of two lateral walls of the outer cover 18 is provided with a passage slot 19 for a transverse section 33 of a bent securing slide rod 3 passing through.

Figure 6:
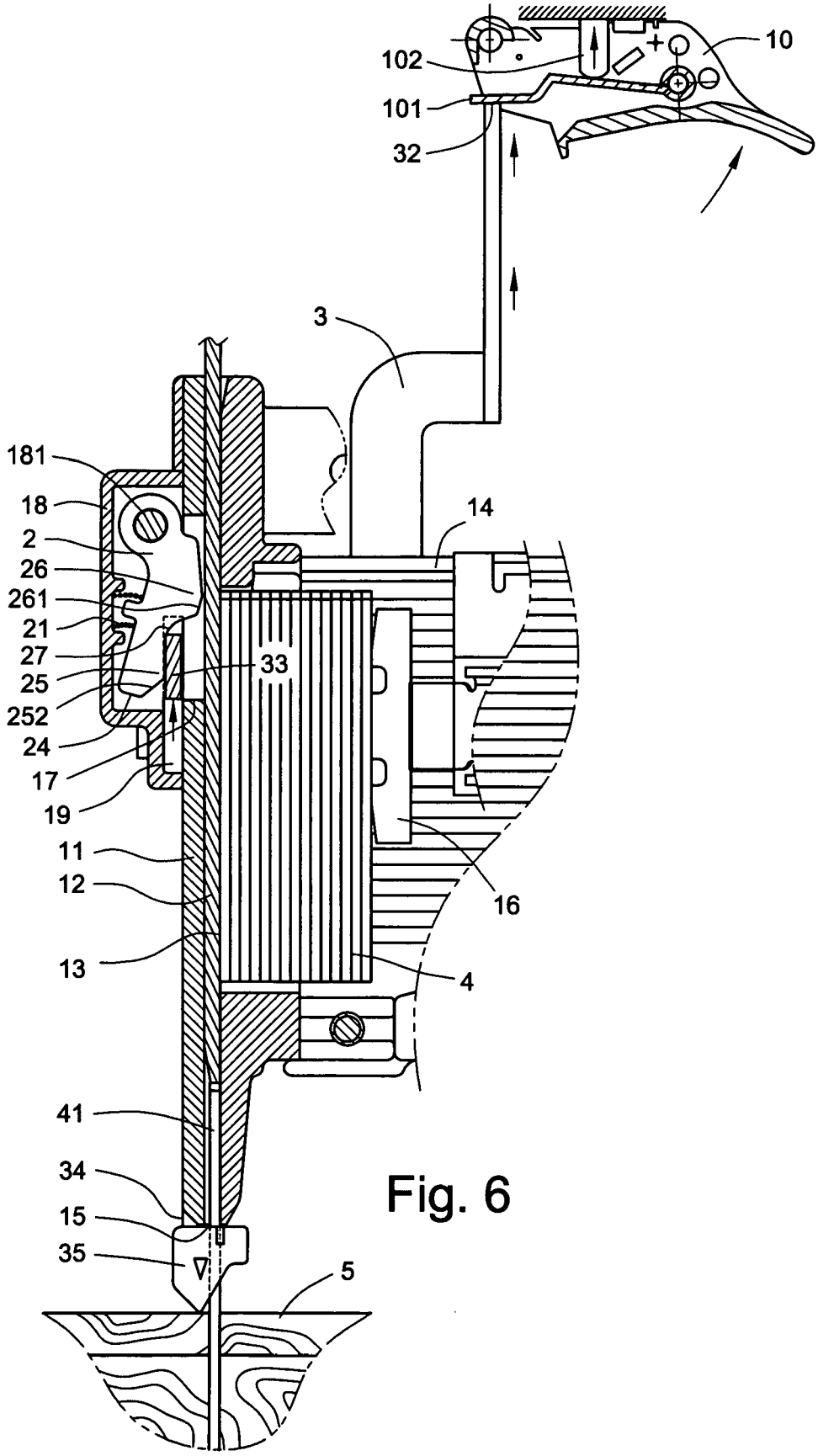
FIG. 6 is another localized lateral cross-sectional view of the present invention used in a nail driver, wherein the fastener guide is fiercely pushed against the surface of a workpiece and wherein the retaining unit undergoes a significant swing so as to depart the second cam from the punch channel and the securing slide rod pushes the flexible plate within the trigger, activating a nail punching.

The above-mentioned securing slide rod 3 of the nail driver 1 has an engaging portion 32 at one end thereof that can press against a flexible plate 101 of a trigger 10. The other end of the securing slide rod 3 is connected to a pressing rod 34 through a nail-depth adjusting knob 3*i*. The end portion of the pressing rod 34 forms a fastener guide 35, which situates outside the bottom side of the nail exit 15, as shown in FIG. 1. To shoot a nail, the fastener guide 35 is urged to press against a workpiece 5, whereby the pressing rod 34 moves the transverse section 33 of the securing slide rod 3 and whereby the engaging portion 32 is shifted upward, as shown in FIG. 6. In a reverse way, as the fastener guide 35 is released from the surface of the workpiece 5, the transverse section 33 of the securing slide rod 3 and the engaging portion 32 return to the original configurations, as shown in FIG. 1. The transverse section 33 is a middle folded section of the securing slide rod 3, which is inserted through the passage slots 19 on two lateral walls of the cover plate 11. Since the fastener guide 35 is coupled with the securing slide rod 3, the transverse section 33 can move synchronically along the passage slots 19.

Figure 2:
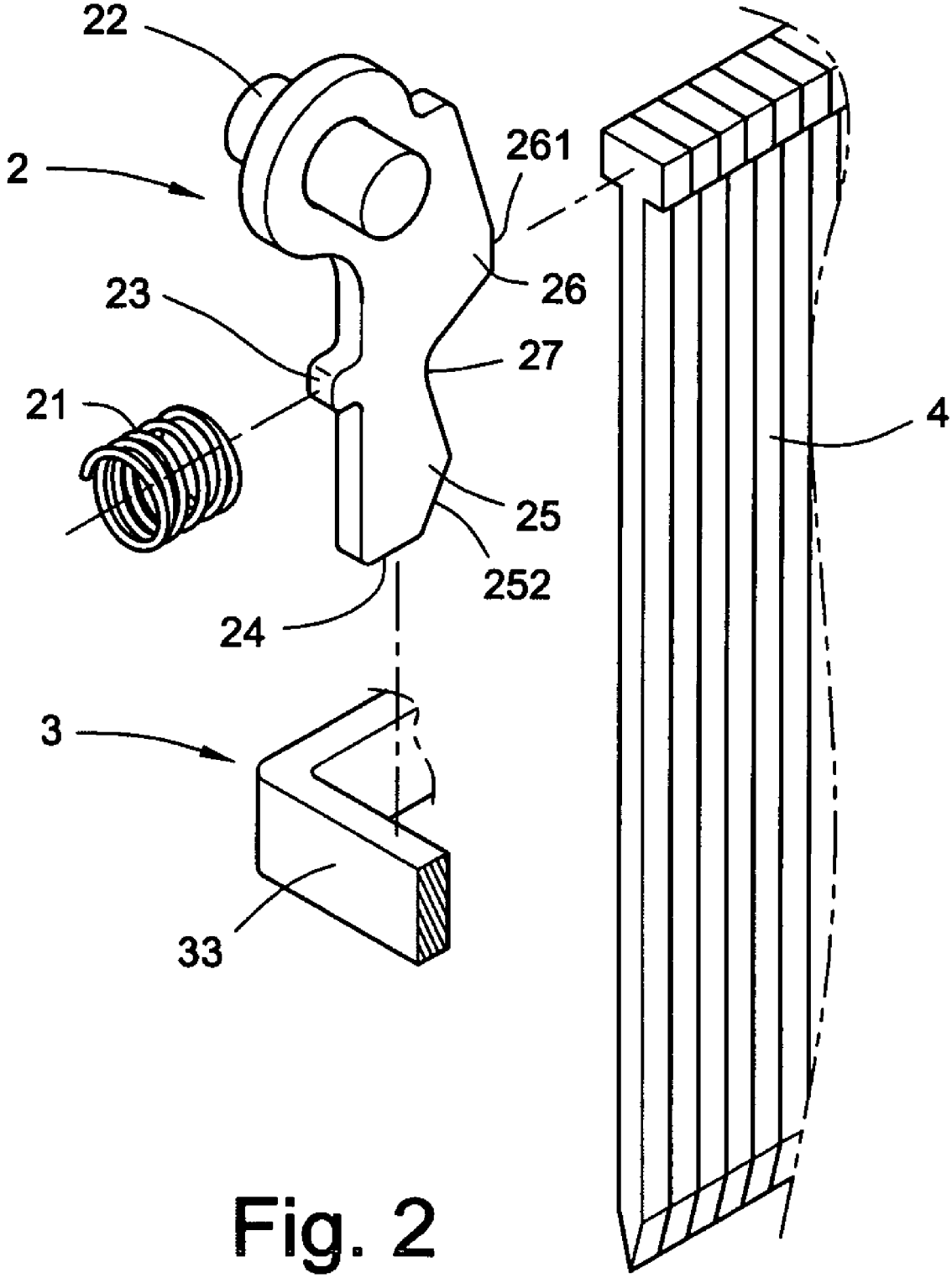
FIG. 2 is a perspective view of a braking unit for nail drivers according to the present invention.

The above-mentioned retaining unit 2 further comprises a front blocking portion 24, a first cam 25 and a second cam 26, as shown in FIG. 2. Between the first cam 25 and the second cam 26, there exists a recess 27. The first cam 25 is connected to the front blocking portion 24 through a slope 252, whereby the transverse section 33 moving upward in the passage slots 19 will push either the slope 252 or the front blocking portion 24, as shown in FIGS. 3 and 4.

Figure 4:
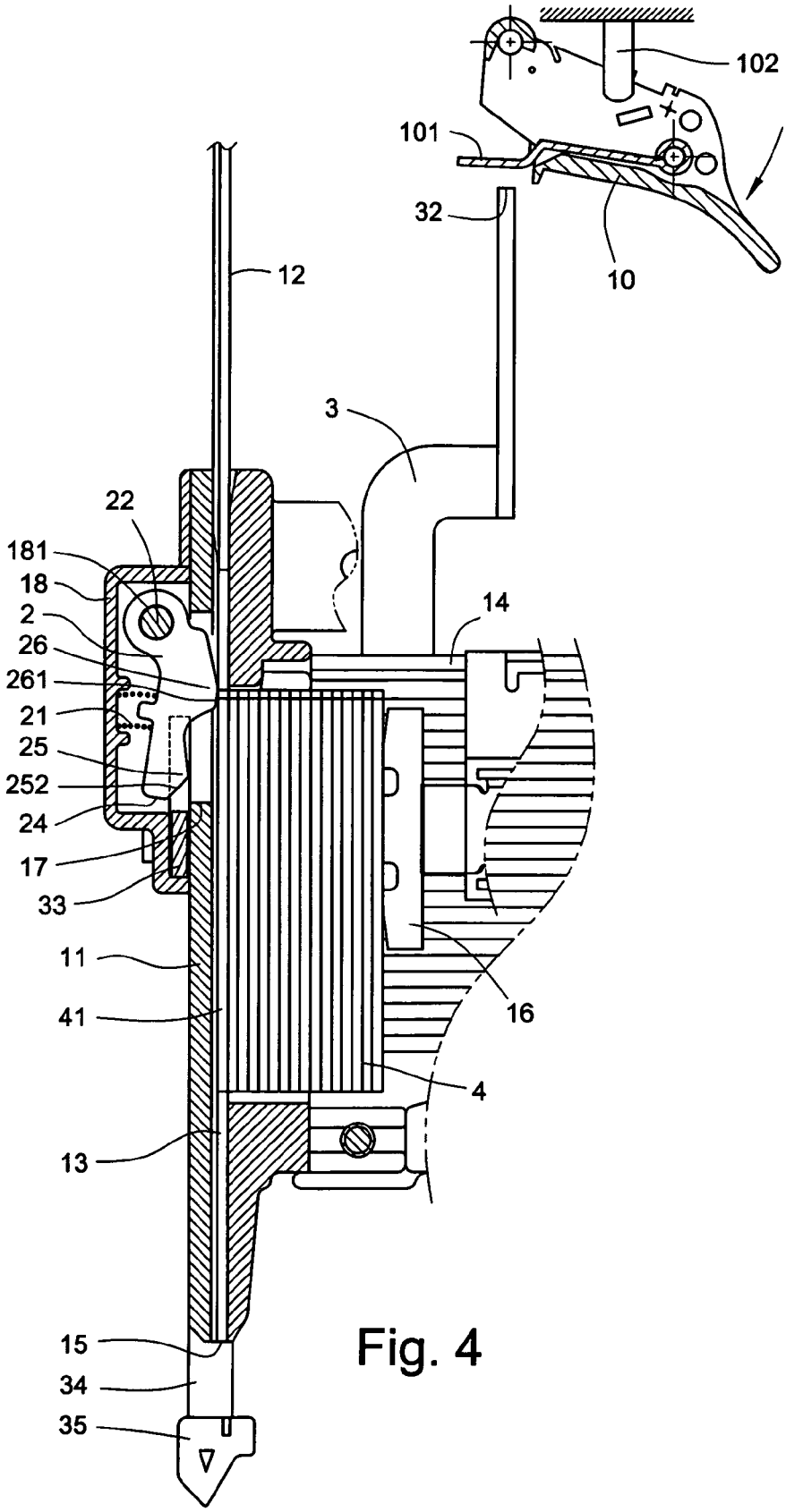
FIG. 4 is another localized lateral cross-sectional view of the present invention used in a nail driver, wherein the nail cartridge is loaded and the nails are pushed by a nail pusher to enter the punch channel and wherein the second cam of the retaining unit moves upward to activate a rotation of the retaining unit, causing the sloppy surface of the first cam to engage the transverse section of the securing slide rod.

The front end of the second cam 26 is provided with a contact face 261, which can be inserted into the punch channel 13 for sensing the unused nails 41 therein, as shown in FIG. 4. Thereby, the retaining unit 2 will be rotated by an angular displacement corresponding to the thickness of a single nail. Further, the second cam 26 can sense whether there is still any nail in the punch channel 13; if there is not any, the retaining unit 2 will stop rotating.

Figure 3:
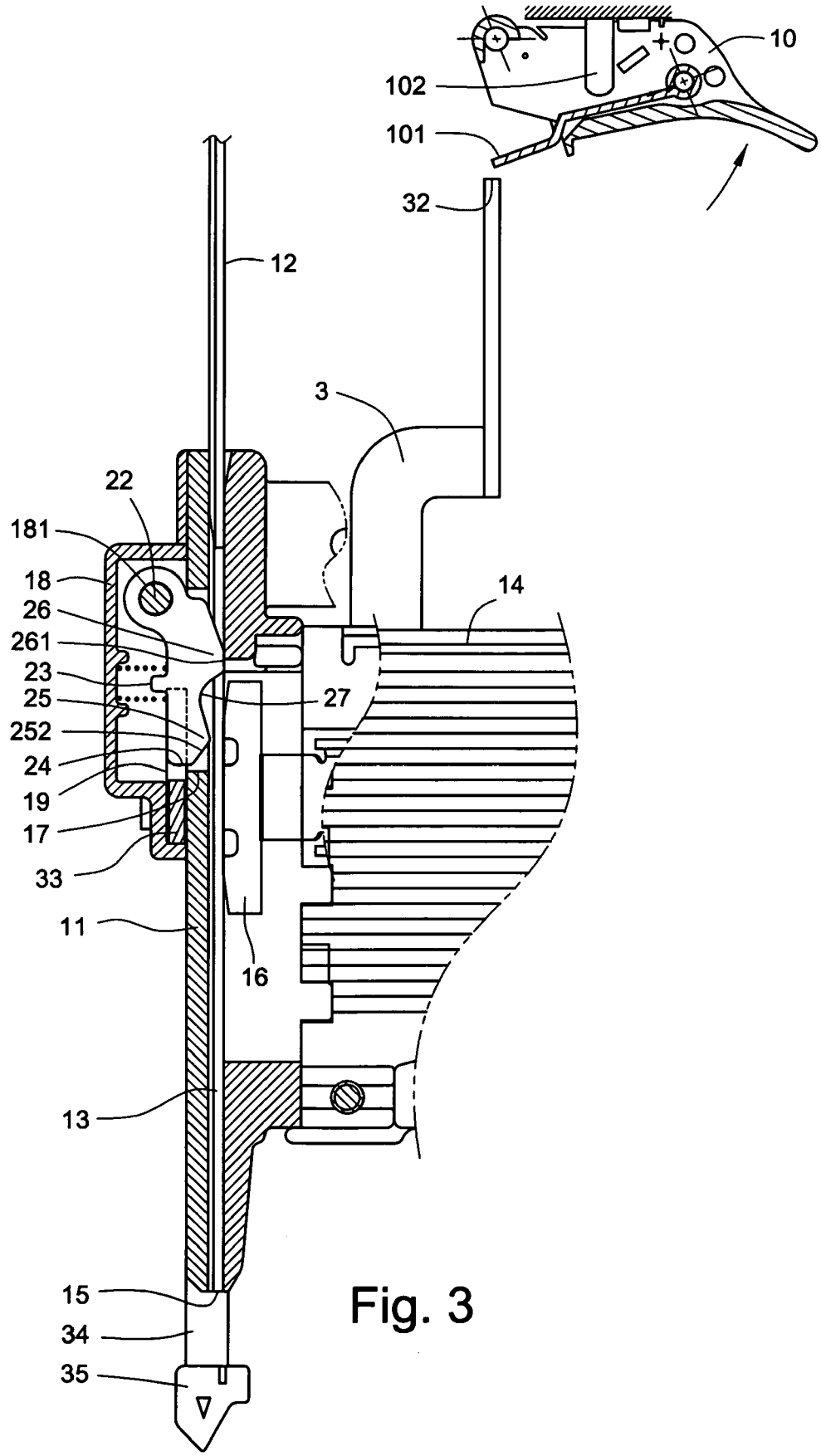
FIG. 3 is a localized lateral cross-sectional view of the present invention used in a nail driver for illustrating the location of the braking unit, wherein the second cam of the retaining unit touches the bottom wall of the punch channel as the nail cartridge is empty and wherein the front blocking portion of the retaining unit restrains the securing slide rod from moving upward.

The retaining unit 2 further includes a projection 23 on which a spring 21 is disposed, whereby the spring 21, sandwiched between the retaining unit 2 and the outer cover 18 (as shown in FIG. 3), is capable of making the retaining unit 2 return to its initial configuration. Further, the spring 21 can be replaced by a torsion spring, flexible plate or any other flexible unit capable of providing a restoring force. Meanwhile, the projection 23 on the retaining unit 2 can be replaced by any other retaining structure such as a slot, a hook or a projected rip, according to the structure of the selected flexible unit. Further, in the preferred embodiment wherein a torsion spring is selected to be the flexible unit attached to the retaining unit 2, the torsion spring is disposed about the axle 22. Therefore, any flexible unit (and the associated structure) having the function of rotating the retaining unit 2 to its initial position falls into the scope of the technical field of the present invention.

The following illustrates the use of the present invention as a braking unit for nail drivers.

As shown in FIG. 3, in the case that there exists no nails 4 in the nail cartridge 14 of the nail driver 1, the resilient nail pusher 16 has yet touched the nails 4. In other words, there are no nails 4 in the nail cartridge 14 and nails 41 in the punch channel 13. The retaining unit 2, driven by the spring 21, urges the contact face 261 of the second cam 26 thereon to touch the bottom wall of the punch channel 13. That is, the retaining unit 2 has yet to rotate, and the front blocking portion 24 situates at a location above the transverse section 33 so as to block any upward shift of the securing slide rod 3. Thereby, the fastener guide 35 cannot be moved by pushing against a surface, and the engaging portion 32 of the securing slide rod 3 will not touch the flexible plate 101. Therefore, even a user pull the trigger 10, the flexible plate 101 will not drive a trigger rod 102 to activate a shot, by which the user is remind of refilling nails 4.

Figure 5:
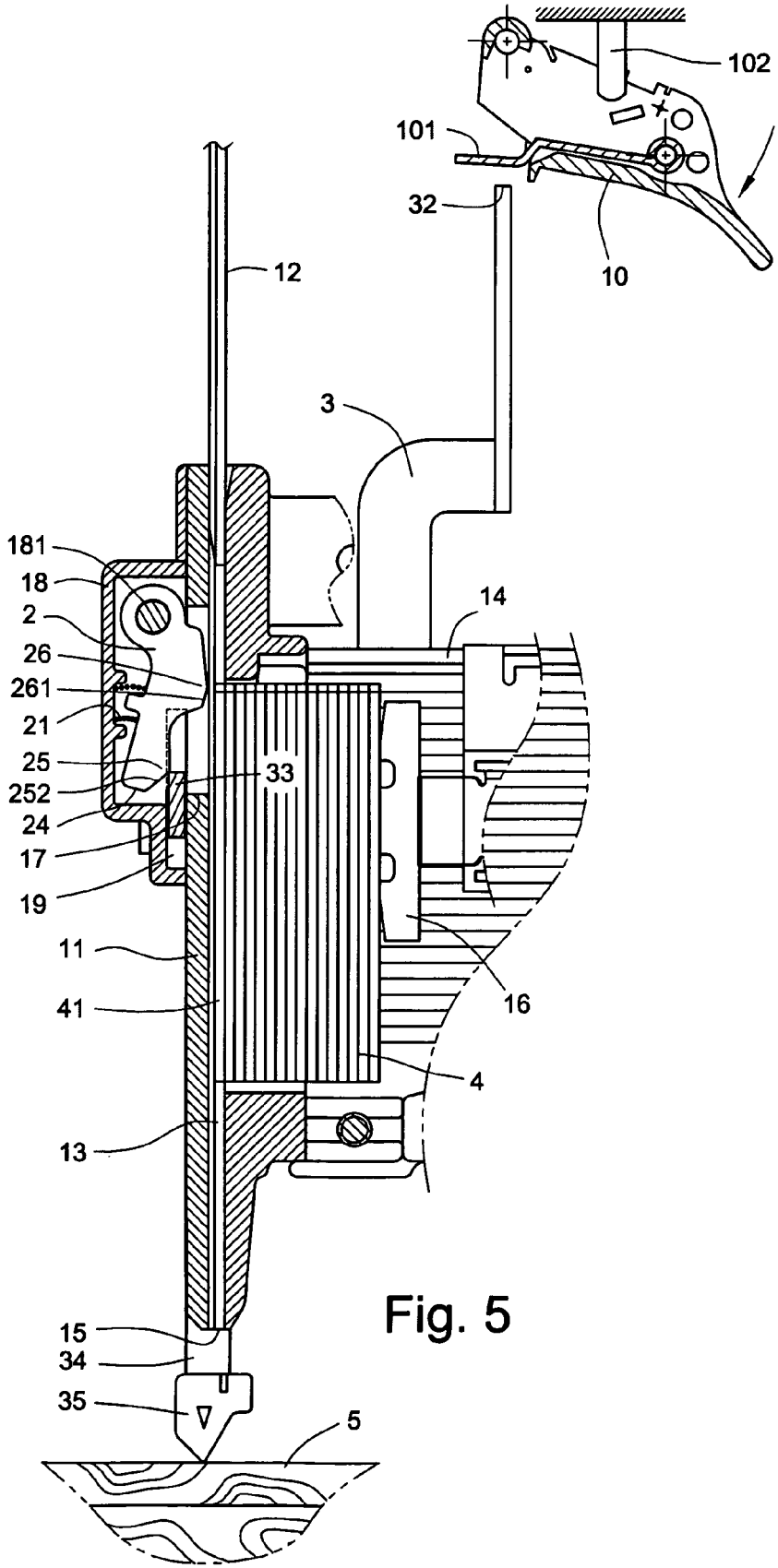
FIG. 5 is another localized lateral cross-sectional view of the present invention used in a nail driver, wherein the fastener guide is slightly pushed against the surface of a workpiece and, wherein the transverse section of the securing slide rod touches the sloppy surface of the retaining unit, departing the second cam from the punch channel.

As a plurality of nails 4 are filled into the nail cartridge 14, the nails 4 are driven by the nail pusher 16 into the punch channel 13, as shown in FIG. 4. The nails 41 within the punch channel 13 will push the contact face 261 of the second cam 26 of the retaining unit 2, forcing the retaining unit 2 to rotate by an angular displacement corresponding to the thickness of a nail at a time. Eventually, the slope 252 of the first cam 25 of the retaining unit 2 moves above the securing slide rod 3 so that the securing slide rod 3 can touch it. As shown in FIG. 5, the user then slightly push the fastener guide 35 against the surface of a workpiece 5, whereby the pressing rod 34 connected to the fastener guide 35 drives the transverse section 33 of the securing slide rod 3 to push the slope 252 of the first cam 25 and whereby the retaining unit 2 will swing to separate the second cam 26 from the punch channel 13. The user then fiercely pushes the fastener guide 35 against the surface of the workpiece 5 (as shown in FIG. 6), the transverse section 33 of the securing slide rod 3 will move from the slope 252 of the first cam 25 to the recess 27, and the retaining unit 2 swings significantly again so a§ to separate the second cam 26 from the punch channel 13 and the second cam 26 hinders a punch rod 12 no more. At the same time, the engaging portion 32 of the securing slide rod 3 moves upward to engage the flexible plate 101 within the trigger 10. Thereby, the user can pull the trigger 10, which urges the trigger rod 102 and in turn drives the punch rod 12 to strike a nail 4.

In other words, when the nails 4 and 41 are used up, the retaining unit 2, driven by the spring 21, will restore to the configuration shown in FIG. 3. In this configuration, the securing slide rod 3 makes the flexible plate 101 within the trigger 10 detached, and therefore the user cannot pull the trigger 10 to drive the flexible plate 101; of course, the trigger rod 102 will not take action. This will remind the user to reload.

Figure 7:
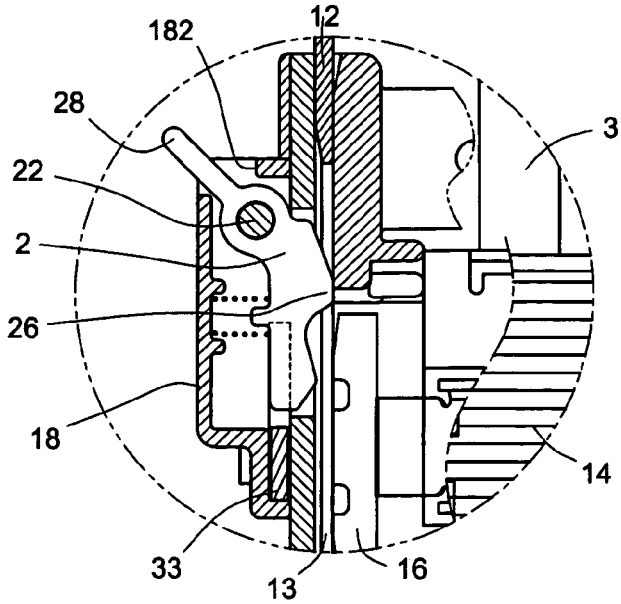
FIG. 7 is another localized lateral cross-sectional view of the present invention used in a nail driver, wherein a handle portion is formed on one lateral side of the retaining unit.
Figure 8:
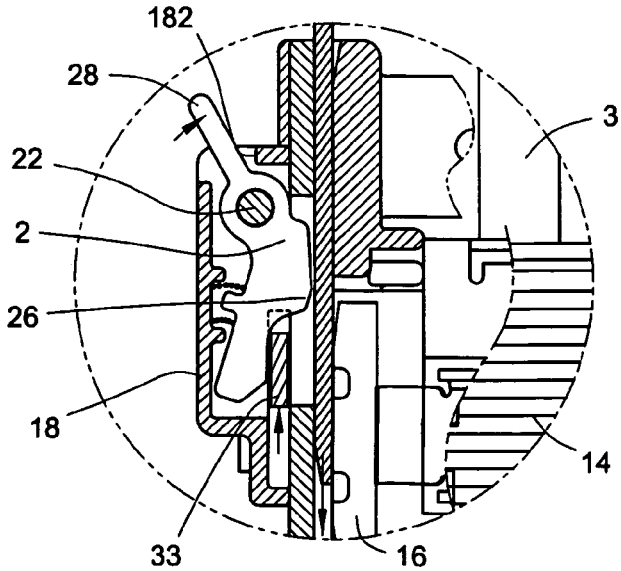
FIG. 8 is another lateral cross-sectional view related to FIG. 7, wherein the handle portion is pulled to depart, the second cam of the retaining unit from the punch channel.

Further, in another preferred embodiment (as shown in FIG. 7), the retaining unit 2 has one side provided with a handle portion 28, extending out of the outer cover 18 through a slot 182 thereon, for a user to rotate the retaining unit 2 about the axle 22. Accordingly, the first cam 25 and the second cam 26 of the retaining unit 2 swing and depart from the punch channel 13, as shown in FIG. 8. Thereby, the user can still pull the securing slide rod 3 and the trigger 10 for driving the punch rod 12 along the punch channel 13 for a strike test.

The above description particularly discloses a technique of using a retaining unit to sensing nails within a nail driver. When the punch channel is empty, the striking mechanism is automatically relieved. Further, such braking mechanism can also be relieved.

Moreover, the outer cover 18 over the retaining unit 2 is not an essential element of the present invention. The pivot of the retaining unit 2 of the present invention can also be installed on two supports formed on two sides of the cover plate 11. A retaining spring 21 is installed on the supports in this case to achieve a restoring mechanism.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A braking unit for nail drivers that have a securing slide rod with a transverse section, said braking unit being a rotary retaining unit pivotally mounted on lateral sides of a punch channel of one said nail driver, comprising:

a front blocking portion capable of engaging said transverse section of said securing slide rod;

a first cam connected to said front blocking portion through a sloped surface, said sloppy surface capable of engaging said transverse section of said securing slide rod so as to depart said retaining unit from said punch channel;

a second cam connected to said first cam through a recess, said second cam capable of being inserted into said punch channel for touching a plurality of nails therein, said second cam being pushed by said nails and activating a rotation of said first cam and said front blocking portion; and a handle portion formed in a lateral end of said retaining unit, whereby said handle portion can be pushed so as to rotate said first cam and said second cam of said retaining unit out of said punch channel.

2. The braking unit for nail drivers of claim 1 wherein said retaining unit is pivotally mounted on an outer cover on an outer side of said punch channel.

3. The braking unit for nail drivers of claim 2 wherein said outer cover is installed on a cover plate on one side of said punch channel.

4. The braking unit for nail drivers of claim 3 wherein said cover plate is provided with a retaining slot for guiding said second cam of said retaining unit into said punch channel.

5. The braking unit for nail drivers of claim 3 wherein two lateral walls of said outer cover are respectively provided with passage slots for receiving the motion of said transverse section of said securing slide rod.

6. The braking unit for nail drivers of claim 3 wherein a top wall of said outer cover is provided with a slot for said handle portion to pass through.

7. The braking unit for nail drivers of claim 1 wherein said recess is capable of housing said transverse section of said securing slide rod.

* * * * *